US005944204A

United States Patent [19]

Vollmer

[11] Patent Number: 5,944,204

[45] **Date of Patent: *Aug. 31, 1999**

[54] HYDRAULIC BOOM COMPENSATION SYSTEM FOR AERIAL DEVICES

[75] Inventor: Edwin L. Vollmer, St. Joseph, Mo.

[73] Assignee: Altec Industries, Inc., Birmingham, Ala.

[ * ] Notice: This patent issued on a continued prosecution application filed under 37 CFR 1.53(d), and is subject to the twenty year patent term provisions of 35 U.S.C. 154(a)(2).

[21] Appl. No.: 08/934,183

[22] Filed: Sep. 19, 1997

[51] Int. Cl.[6] ..... B66C 23/08

[52] U.S. Cl. ..... 212/261; 182/2.9; 212/238; 414/708

[58] Field of Search ..... 414/708; 173/193; 212/256, 238, 261; 182/2.9

[56] References Cited

U.S. PATENT DOCUMENTS

| | | | |
|---|---|---|---|
| 2,798,626 | 7/1957 | Lapsley | 414/708 |
| 3,352,441 | 11/1967 | Alden | 414/708 |
| 3,374,975 | 3/1968 | Bronder | 173/193 |
| 3,415,021 | 12/1968 | Myers . | |
| 3,604,533 | 9/1971 | Eckels et al. . | |
| 4,081,055 | 3/1978 | Johnson . | |
| 4,089,388 | 5/1978 | Johnson . | |
| 4,113,054 | 9/1978 | Myers . | |
| 4,146,998 | 4/1979 | Johnson . | |
| 4,187,927 | 2/1980 | Byrne . | |
| 4,222,457 | 9/1980 | Ashworth . | |
| 4,252,213 | 2/1981 | Ekman . | |
| 4,427,121 | 1/1984 | Clements . | |
| 4,453,672 | 6/1984 | Garnett . | |
| 4,461,369 | 7/1984 | Amador . | |
| 4,602,462 | 7/1986 | Anderson . | |
| 4,643,273 | 2/1987 | Stokoe . | |
| 4,775,029 | 10/1988 | MacDonald et al. . | |
| 4,858,723 | 8/1989 | Holmes et al. . | |
| 4,944,364 | 7/1990 | Blasko . | |
| 5,016,767 | 5/1991 | Thibault . | |
| 5,307,898 | 5/1994 | Purdy et al. . | |

FOREIGN PATENT DOCUMENTS

| | | | |
|---|---|---|---|
| 402654 | 10/1973 | U.S.S.R. | 173/193 |
| 589386 | 1/1978 | U.S.S.R. | 173/193 |
| 729345 | 4/1980 | U.S.S.R. | 173/193 |
| 1420851 | 1/1976 | United Kingdom | 173/193 |

*Primary Examiner*—Thomas J. Brahan
*Attorney, Agent, or Firm*—Shook, Hardy & Bacon, LLP

[57] ABSTRACT

An upper boom compensation system for an aerial device having an articulating boom assembly. The lower boom is raised and lowered by a special double cylinder having two pistons and a common piston rod. A hydraulic circuit is arranged to transfer fluid between the lower boom cylinder and the upper boom cylinder in a manner to raise and lower the upper boom correspondingly to raising and lowering of the lower boom. The upper boom can also be controlled independently of the lower boom.

6 Claims, 3 Drawing Sheets

Fig. 3(a).
RAISING LOWER BOOM
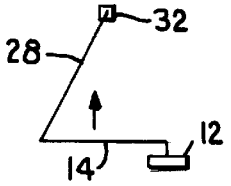
RAISING UPPER BOOM
O/C VALVE NOT YET ACTUATED
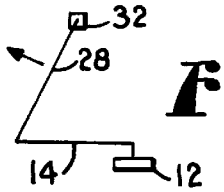
Fig. 3(b).
LOWERING LOWER BOOM
FROM FULL UP BOOMS
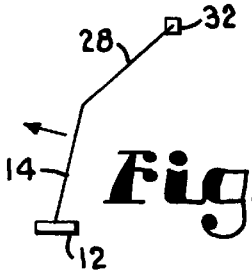
Fig. 3(d).
RAISING UPPER BOOM
O/C VALVE ACTUATED
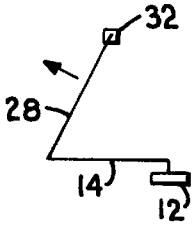
Fig. 3(c).
RAISING UPPER BOOM
AND LOWER BOOM AT
THE SAME TIME
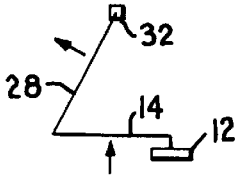
Fig. 3(f).
LOWERING LOWER BOOM
FROM FULL UP LOWER
BOOM, UPPER BOOM
DOWN (VERTICAL)
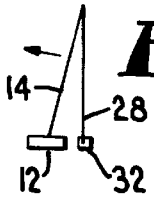
Fig. 3(e).
RAISING UPPER BOOM
AND LOWERING LOWER
BOOM AT THE SAME TIME
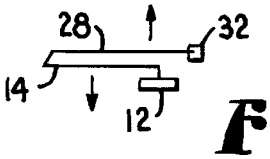
Fig. 3(g).

HYDRAULIC BOOM COMPENSATION SYSTEM FOR AERIAL DEVICES

FIELD OF THE INVENTION

This invention relates in general to aerial devices and more particularly to a hydraulic boom compensating system for an articulating boom assembly.

BACKGROUND OF THE INVENTION

Vehicle mounted aerial devices are commonly used to perform work on utility poles, utility lines and other overhead equipment. Typically, the aerial device has a boom assembly which is mounted for rotation on the bed of a utility vehicle. A personnel carrying platform is mounted on the end of the boom assembly to allow workers to be properly positioned for the job that faces them. The boom assembly can be either a telescoping assembly or an articulating assembly in which upper and lower booms are pivoted together end to end. The present invention relates to articulating boom assemblies.

Articulating booms may be equipped with what is commonly known as an upper boom compensation system. The compensation system automatically actuates the upper boom cylinder or mechanically moves it when the lower boom is moved, thus assuring that the desired positioning of the upper boom and platform accompanies lower boom movement. An upper boom compensation aerial device effectively reduces the time required to place the operator at the desired work location, thus making the operator more productive, and reduces the amount of control valve manipulation by the operator, thereby simplifying his job. Different types of systems have been proposed to achieve upper boom compensation.

In one type of compensation system, a sliding link mechanism is mounted in the lower boom and attached at a location offset from the lower boom pivot point. The base of the upper boom cylinder is connected with the slide mechanism such that the upper boom cylinder base moves when the lower boom is pivoted up and down. This movement of the upper boom cylinder base causes the upper boom cylinder, acting as a fixed link, to pivot the upper boom up and down to correspond with up and down movement of the lower boom. Actuation of the upper boom cylinder also allows operation of the upper boom independently of the lower boom.

Another known type of boom compensation system makes use of a parallelogram arrangement which includes the lower boom and a rigid link that is maintained parallel to the lower boom. The parallelogram configuration causes the upper boom to maintain its attitude relative to horizontal as the lower boom is raised and lowered. An upper boom cylinder allows the upper boom to be raised and lowered independently of the lower boom.

These mechanical systems have functioned in a satisfactory manner for the most part. However, they involve complicated mechanics and the usual problems associated with mechanical equipment that can be subjected to significant loads. The parts are susceptible to wear which can inhibit their performance, particularly after prolonged service. The repair and maintenance requirements can be considerable. The need to provide a complicated mechanical system can be a significant factor in the overall cost of the machine.

SUMMARY OF THE INVENTION

The present invention is directed to a boom compensation system that operates hydraulically and thus eliminates in large part the problems associated with mechanical systems.

In accordance with the invention, a special double cylinder is used as the lower boom actuating cylinder. The double cylinder is constructed as essentially two hydraulic cylinders connected end to end with a common piston rod and separate pistons. This provides each cylinder with two separate fluid chambers or four chambers in all. The upper boom actuating cylinder is a conventional hydraulic cylinder having the chamber at its base end connected with the outermost chamber of the lower boom cylinder.

The hydraulic system is equipped with plumbing and valving that allows fluid from the outermost chamber of the lower boom to be exchanged with fluid in the base end of the upper cylinder. Consequently, when the lower boom cylinder is extended and retracted to raise and lower the lower boom, the upper cylinder extends and retracts to correspondingly raise and lower the upper boom. Provision is made for independent operation of the upper boom through the plumbing and valving system.

BRIEF DESCRIPTION OF THE DRAWINGS

In the accompanying drawings which form a part of the specification and are to be read in conjunction therewith and in which like reference numerals are used to indicate like parts in the various views:

FIGS. 3(*a*)–3(*g*) are diagrams depicting various positions and movements of the two booms included in the articulating boom assembly shown in FIG. 1.

DETAILED DESCRIPTION OF THE INVENTION

Figure 1:
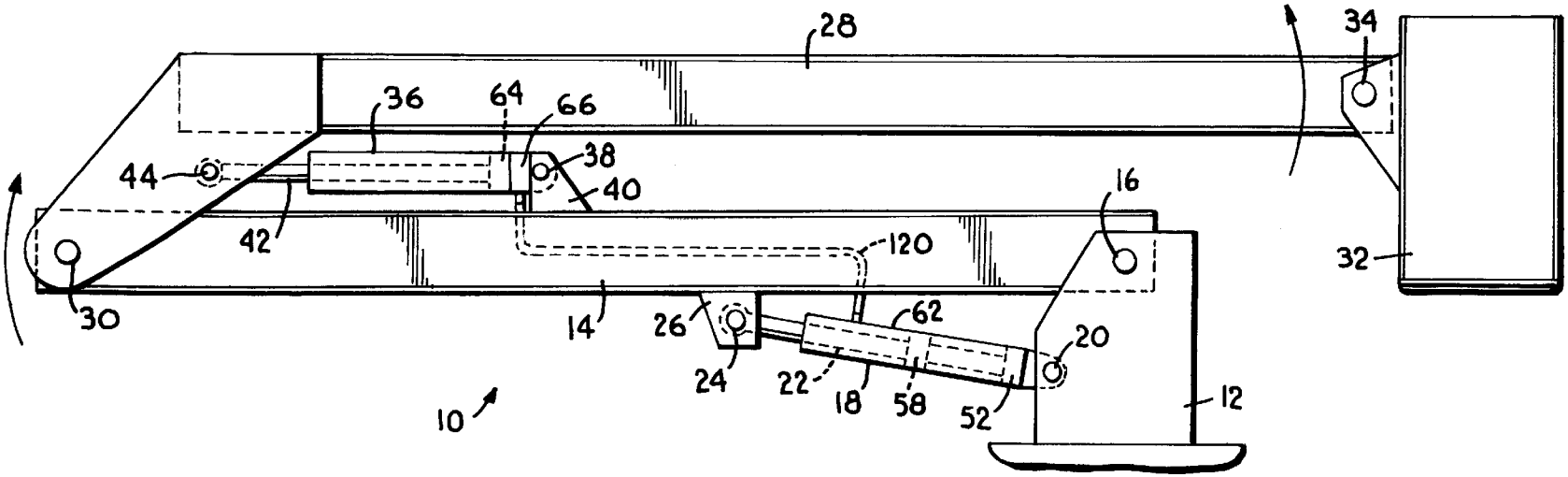
FIG. 1 is a simplified diagrammatic view of an articulating boom assembly equipped with a hydraulic boom compensation system constructed in accordance with a preferred embodiment of the present invention.

Referring now to the drawings in more detail and initially to FIG. 1, numeral 10 generally designates an articulating boom assembly of the type that is commonly employed as part of an aerial device mounted on a truck bed (not shown). A turntable or turret 12 is mounted on a frame or pedestal (not shown) on the vehicle bed and thus can turn about a vertical axis. One end of a lower boom 14 is pivotally connected at 16 for up and down movement about the horizontal axis of the pivot pin 16. A specially constructed lower boom cylinder 18 is connected between the turntable 12 and the lower boom 14 in order to effect up and down pivotal movement of the lower boom. The base end of cylinder 18 is pivotally pinned at 20 to the turntable 12. The lower boom cylinder 18 has a piston rod 22 which extends to pivot the lower boom 14 upwardly and retracts to lower the lower boom. The end of the piston rod 22 is pivotally pinned at 24 to a bracket 26 which projects from the lower boom 14.

The boom assembly 10 includes an upper boom 28 which is pivotally pinned at one end to the end of the lower boom 14 by a horizontal pivot pin 30. The opposite or tip end of the upper boom 28 is equipped with a personnel carrying platform 32 which is pinned to boom 28 by a horizontal platform pin 34. A conventional hydraulic cylinder 36 has its base end pinned at 38 to a bracket 40 projecting from the lower boom 14. Cylinder 36 has a piston rod 42 which is pinned at its end to the upper boom 28 by a pivot pin 44. Pin 44 is offset from pin 30 so that extension of piston rod 42 pivots the upper boom 28 upwardly relative to the lower boom 14, while retraction of rod 42 pivots boom 28 downwardly relative to boom 14. Quite often, additional linkages are employed between pivot pin 44 and the upper boom to accomplish greater angles of upper boom motion.

Figure 2:
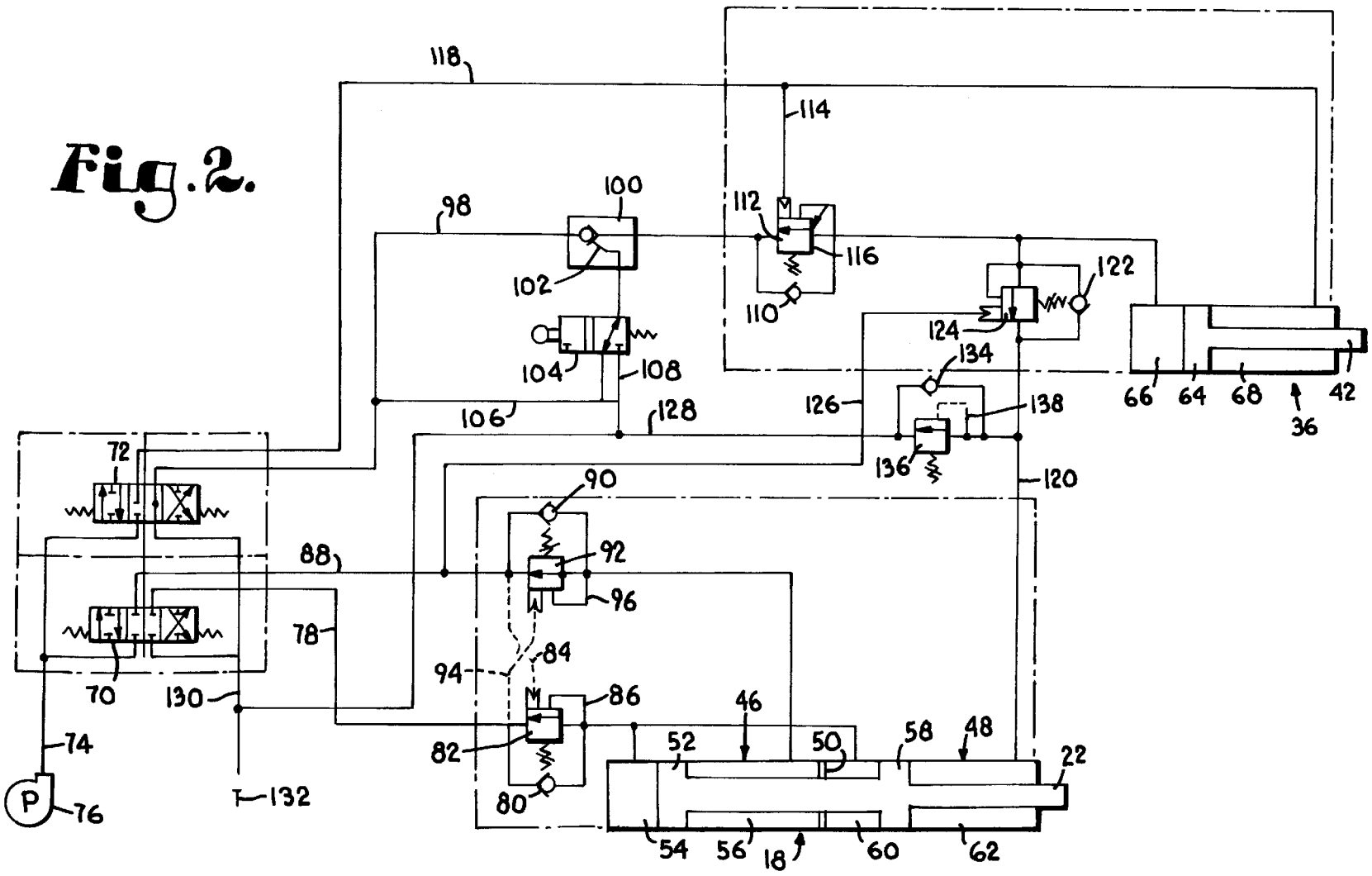
FIG. 2 is a schematic diagram of the hydraulic circuit and valving that is included in the boom compensation system of the present invention.

FIG. 2 schematically depicts a hydraulic circuit which controls the application of hydraulic fluid to the boom cylinders 18 and 36. Cylinder 18 is constructed as a double cylinder having a pair of cylindrical housings or barrels 46 and 48 connected end to end. The piston rod 22 is common to both of the barrels 46 and 48 and extends slidably through a partition 50 which forms a common end for the two barrels 46 and 48. The inward end of the piston rod 22 carries a piston 52 which is located in barrel 46 and separates barrel 46 into two chambers 54 and 56 located on opposite sides of piston 52. The chamber 54 is located at the base end of barrel 46 such that application of fluid pressure to it forces piston 52 in a direction to extend the piston rod 22. The other chamber 56 is located such that application of fluid to it forces piston 52 in a direction to retract the rod 22.

The piston rod 22 carries a second piston 58 near its center at a location within barrel 48. Piston 58 separates the barrel 48 into two chambers 60 and 62 located on opposite sides of piston 58. Chamber 60 is located at the base end of barrel 48 adjacent to partition 50 such that application of fluid to chamber 60 forces piston 58 outwardly in a direction to extend piston rod 22. The other chamber 62 is located such that application of fluid to it forces piston 58 toward partition 50 and retracts the piston rod 22.

The piston rod 42 of the upper boom cylinder 36 is provided with a piston 64 which separates the cylinder barrel into a pair of chambers 66 and 68 located on opposite sides of the piston 64. Chamber 66 is located at the base end of cylinder 36 and serves as an "extend" chamber which extends the piston rod 42 when fluid is applied to it. The other chamber 68 is located such that the application of fluid to it forces piston 64 toward the base of the cylinder and thus retracts the piston rod 42.

With continued reference to FIG. 2, the hydraulic circuit includes a lower boom actuating valve 70 and an upper boom actuating valve 72 which are normally maintained in the neutral positions which are shown. Both of the valves 70 and 72 are connected with a supply line 74 which receives hydraulic fluid under pressure from a pump 76. The downstream side of valve 70 connects with a hydraulic line 78 that connects through a check valve 80 with chambers 54 and 60 of cylinder 18. The check valve 80 allows fluid flow toward the connected chambers 54 and 60 but normally blocks flow through line 78 in the opposite direction toward valve 70. Arranged in parallel with the check valve 80 is a pilot operated valve 82 which is normally in the closed position shown in FIG. 2. Valve 82 is moved to the open position when sufficient fluid pressure is applied to its pilot line 84, or when pressure in excess of a fixed amount (such as 3000 psi) is applied to a pressure relief line 86. In the open position, valve 82 allows fluid flow through line 78 in a direction from the chambers 54 and 60 toward valve 70.

The downstream side of valve 70 connects with another hydraulic line 88 which connects through a check valve 90 with chamber 56 of cylinder 18. The check valve 90 allows flow in a direction from valve 70 toward chamber 56 but blocks flow in the opposite direction. Arranged in parallel with check valve 90 is a pilot operated valve 92 which is normally closed. However, valve 92 is moved to the open position shown in FIG. 2 when fluid pressure is applied to a pilot line 94 which connects with line 78. When valve 92 is in the open position, it allows flow along line 88 in a direction from chamber 56 toward the lower boom actuating valve 70. In the event of an excessive pressure build up (such as pressure exceeding 3000 psi), the excessive pressure applied along line 96 acts to open valve 92 in order to relieve the excessive pressure.

The downstream side of the upper boom valve 72 connects with a hydraulic line 98. Line 98 is equipped with a pilot operated check valve 100 which normally blocks flow through line 98 in a direction toward the upper boom valve 72. However, valve 100 has a pilot line 102 which opens the normally closed check valve 100 when fluid is applied to line 102. The pilot line 102 is controlled by a shift valve 104 which connects on one side with line 98 through line 106. In the normal position of valve 104 shown in FIG. 2, valve 104 connects line 106 with the pilot line 102 and thus opens valve 100 to flow in both directions when fluid pressure is applied to line 98 (and through line 106 and valve 104 to the pilot line 102). However, when valve 104 is shifted from the position of FIG. 2, lines 102 and 106 are disconnected, and the pilot line 102 is connected with a low pressure line 108 so that the check valve 100 blocks flow in one direction through line 98.

Downstream from valve 100, line 98 connects through a check valve 110 with the "extend" chamber 66 of the upper boom cylinder 36. The check valve 110 allows flow along line 98 in a direction from valve 72 toward chamber 66 but blocks flow in the opposite direction. Arranged in parallel with the check valve 110 is a pilot operated valve 112 which is normally in the closed position shown in FIG. 2. Valve 112 has a pilot line 114 which, when subjected to fluid pressure, moves valve 112 to an open position in which fluid flow is allowed along line 98 in a direction from chamber 66 toward the upper boom valve 72. When excessive pressure is applied to a pressure relief line 116, valve 112 moves to the open position in order to relieve the excessive pressure.

Also connected with the downstream side of the upper boom cylinder 72 is another hydraulic line 118 which extends to chamber 68 of the upper boom cylinder 36. Lines 98, 118, and low pressure line 130 are connected through valve 72 when valve 72 is in the neutral position. Line 118 connects with the pilot line 114 for opening valve 112 when line 118 is pressurized.

A fluid transfer line 120 extends from chamber 62 of the lower boom cylinder 18 to chamber 66 of the upper boom cylinder 36 through a check valve 122. The check valve 122 allows flow through line 120 in a direction from chamber 62 to chamber 66 but blocks flow in the opposite direction. Arranged in parallel with the check valve 122 is a pilot operated valve 124 which is normally in the closed position shown in FIG. 2. However, when fluid pressure is applied to a pilot line 126 for valve 124, valve 124 moves to the open position in which it allows fluid flow through line 120 in a direction from chamber 66 to chamber 62. The pilot line 126 connects with line 88.

A low pressure line 128 connects with line 108 and with a low pressure tank line 130 which connects with a hydraulic reservoir 132 and with the boom actuating valves 70 and 72. Fluid flow from line 120 to line 128 is blocked by a check valve 134 and by a normally closed pressure relief valve 136. In the event of excessive pressure in line 120, valve 136 is opened by a pressure relief line 138, and valve 136 then relieves the excess pressure by allowing flow from line 120 to the low pressure line 128.

In operation, the compensation system of the present invention effects automatic movement of the upper boom 28 in order to compensate for up and down movement of the lower boom 14. For example, referring first to FIG. 3(*a*), the lower boom 14 can be raised from the FIG. 3(*a*) position by shifting the lower boom actuating valve 70 to the left from the neutral position shown in FIG. 2. Then, the pressure line 74 is connected through valve 70 with line 78, and the fluid is applied through the check valve 80 to chambers 54 and 60 of cylinder 18. This causes extension of the piston rod 22 and raises the lower boom 14 about its pivot connection with the turntable 12. The fluid in chamber 56 is returned to the reservoir 132 through valve 92 (which is open due to the application of pressure to its pilot line 94) and valve 70 to the tank line 130.

In order to decrease the time involved in getting the operator to the desired work position and reduce the amount of valve manipulation required of the operator, the compensation system causes the upper boom to pivot upwardly relative to the lower boom 14 to an extent corresponding to the raising of the lower boom. When the lower boom piston rod 22 is extended, piston 58 is carried with it toward the outer end of cylinder 18, thus displacing fluid from chamber 62 through line 120 and check valve 122 to chamber 66 of the upper boom cylinder 36. This transfer of fluid into chamber 66 acts against piston 64 and causes the piston rod 42 to extend. The volume of chamber 62 of the lower boom cylinder 18 and chamber 66 of upper boom cylinder 36 are selected such that the volume of oil displaced to and from chambers 62 and 66 effects a desired amount of motion of the upper boom 28 at a given amount of motion of lower boom 14.

With the shift valve 104 in the position shown in FIG. 2, the upper boom 28 can be raised independently of the lower boom. With reference to FIG. 3(*b*), shifting of the upper boom actuating valve 72 to the left from the neutral position shown in FIG. 2 connects line 74 through valve 72 with line 98. The fluid conveyed through line 106 and valve 104 to the pilot line 102 causes valve 100 to open. Consequently, the fluid pressure applied to line 98 passes through valve 100 and check valve 110 to chamber 66 of the upper boom cylinder 36. This extends the piston rod 42 and raises the upper boom 28 relative to the lower boom 14 independently of any movement of the lower boom. The fluid in chamber 68 is relieved through line 118 and valve 72 to line 130 and back to the tank 132.

If an attempt is made to raise the upper boom from the position shown in FIG. 3(*c*) when the shift valve 104 has been actuated or moved to the right from the position shown in FIG. 2, the upper boom does not move. In this situation, the pilot line 102 is disconnected from line 106 and is instead connected to the low pressure line 108. Consequently, valve 100 is closed to prevent fluid applied to line 98 from reaching chamber 66 to effect extension of the upper boom cylinder. Although the upper boom cylinder 36 is under compression under these circumstances, the fluid that is trapped in chamber 66 prevents the piston rod 42 from retracting. The check valves 110 and 122 maintain the pressure in chamber 66 unless excessive pressure conditions build up.

FIG. 3(*d*) depicts a situation where the lower boom is to be lowered from a boom configuration in which both booms are fully extended or nearly fully extended. When the lower boom actuating valve 70 is shifted to the right from the neutral position shown in FIG. 2, the pressure line 74 is connected through valve 70 with line 88 and through the check valve 90 to chamber 56. Piston 52 is forced toward the base end of the cylinder to retract the piston rod 22 and lower the lower boom 14. The pressure in line 88 is applied to the pilot line 84, thus opening valve 82 and allowing the fluid pressure in chambers 54 and 60 to be relieved through line 78, valve 70, and line 130 to the tank 132.

The pressure applied to line 88 is also applied to the pilot line 126 of valve 124. As a result, valve 124 is opened so that flow is permitted from chamber 66 through line 120 to chamber 62. Because the upper boom cylinder 36 is under compression and the lower boom cylinder rod 22 is retracting, the upper boom cylinder 42 retracts and fluid is displaced from chamber 66 into chamber 62. Thus, as the lower boom 14 is lowered, the upper boom 28 is lowered to a corresponding extent.

FIG. 3(*e*) depicts a situation in which the lower boom is in a fully up position and the upper boom is in a fully down position. If valve 70 is shifted to the right under these conditions to lower the lower boom, the pressure line 74 is connected through valve 70 with line 88, and fluid is applied through the check valve 90 to chamber 56. This retracts the piston rod 22 to lower the lower boom 14. The upper boom piston 64 is fully retracted, and the upper boom cylinder 36 is not under a compressive load under these conditions. Consequently, fluid is not transferred between chambers 66 and 62 even though valve 124 is open due to the application of fluid to the pilot line 126. Thus, the upper boom 28 maintains its attitude relative to the lower boom 14. Because fluid is no longer being transferred from chamber 66 to chamber 62, fluid is now being replenished in chamber 62 from tank 132 through line 128 and check valve 134, thus preventing a vacuum condition in chamber 62.

FIG. 3(*f*) depicts a situation in which both of the boom actuating valves 70 and 72 are moved to the left from the neutral position shown in FIG. 2 to raise both the lower boom 14 and the upper boom 28. The pressure line 74 is then connected through valve 70 with line 78, and fluid is applied to chambers 54 and 60 through the check valve 80, causing rod 22 to extend. Line 74 is also connected through valve 72 with line 98, and, with valve 104 in the position shown, valve 100 is open so that fluid is applied through it and the check valve 110 to chamber 66. This causes the upper boom cylinder piston rod 42 to extend. The fluid in chamber 56 is relieved through valve 92, line 88 and valve 70 to the tank line 130. Similarly, the fluid in chamber 68 is relieved through line 118 and valve 72 to the tank line 130. Normally, when rod 22 is extended, the fluid in chamber 62 is transferred to chamber 66. However, if conditions arise due to flow constraints possible in the situation depicted in FIG. 3(*f*) or other blockage of flow from chamber 62 to chamber 66, pressure buildup in relief line 138 causes relief valve 136 to open and relieve the pressure through line 128 to tank 132.

FIG. 3(*g*) depicts a position of the boom assembly in which the upper boom is raised and the lower boom is lowered at the same time when both booms are nearly fully lowered. Valve 70 is shifted to the right from the neutral position of FIG. 2 and valve 72 is shifted to the left. The pressure line 74 is connected through valve 70 with line 88, thus applying fluid through check valve 90 to chamber 56 and retracting the lower boom cylinder 18. The fluid in chambers 54 and 60 is relieved through piloted open valve 82, line 78 and valve 70 to the tank line 130. Shifting of valve 72 to the right connects the pressure line 74 with line 98 and, with valve 104 in the position shown in FIG. 2, results in the application of fluid to chamber 66 for extension of the upper boom cylinder 36. The fluid in chamber 68 is relieved through line 118 and valve 72 to the tank line 130. The fluid applied to line 88 is also applied to the pilot line 126 for valve 124, thus opening valve 124. The relatively high fluid pressure applied through line 98 to chamber 66 is thus communicated through valve 124 to line 120 and chamber 62. Consequently, as the lower boom cylinder piston rod 22 retracts, fluid is supplied to chamber 62.

As an alternative to the connection shown in FIG. 1 for the rod end of the upper boom cylinder 36, some aerial devices have a mechanical linkage connected with the upper boom cylinder rod to allow increased angles of upper boom motion. The present invention is equally well suited for machines having such a linkage, as well as other variations that are known in the industry.

It is thus evident that the boom compensation system of the present invention operates in a reliable manner to assure that compensation is made in the position of the upper boom when the lower boom is raised and lowered. The use of hydraulic circuitry to accommodate the transfer of fluid between the upper and lower boom cylinders results in an economical and efficient system that is not plagued by the cost, maintenance, and repair problems that are commonly associated with mechanical systems.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. An articulating aerial device boom assembly for a vehicle comprising:

a lower boom pivoted to a turntable on the vehicle for up and down pivotal movement, said turntable being mounted on the vehicle to turn about a generally vertical axis;

a lower boom cylinder connected between the turntable and the lower boom and being extensible and retractable to raise and lower the lower boom, said lower boom cylinder including a cylinder housing presenting first and second cylinders arranged end to end, a piston rod in said housing extending in said first and second cylinders, said rod being extensible to raise the lower boom and retractable to lower the lower boom, a first piston carried on said rod in the first cylinder and separating the first cylinder into first and second chambers, and a second piston carried on said rod in the second cylinder and separating the second cylinder into third and fourth chambers, said first and third chambers being coupled to a common fluid supply source and being located to extend the rod upon application of fluid thereto and said second and fourth chambers being located to retract the rod upon application of fluid thereto;

an upper boom pivoted to said lower boom for up and down pivotal movement relative thereto;

a personnel carrying platform pivotally mounted on said upper boom and adapted to carry personnel;

an upper boom cylinder arranged between said lower and upper booms and being extensible and retractable to pivot the upper boom up and down relative to the lower boom; and means for applying fluid to one of said boom cylinders to effect selected movement of the boom corresponding to said one cylinder and to effect transfer of fluid from said one boom cylinder to the other boom cylinder to effect selected movement of the boom corresponding to said other boom cylinder.

2. A boom assembly as set forth in claim 1, including means for effecting selected movement of the boom corresponding to said other boom cylinder independently of the application of fluid pressure to said one boom cylinder.

3. A boom assembly as set forth in claim 1, wherein:

said upper boom cylinder presents an extend chamber located to extend the upper boom cylinder upon application of fluid thereto and a retract chamber located to retract the upper boom cylinder upon application of fluid thereto; and said fluid applying means includes means for applying fluid to said first and third chambers and a conduit connecting said fourth chamber to said extend chamber to direct fluid therebetween for extension of said upper boom cylinder when the lower boom cylinder is extended.

4. A boom assembly as set forth in claim 3, including means for selectively applying fluid to said extend chamber independently of the application of fluid to said first and third chambers.

5. A boom compensation system for an articulating boom assembly of an aerial device mounted on a vehicle and having upper and lower booms pivoted together, a personnel carrying platform pivotally mounted on the upper boom and adapted to carry personnel, and means mounting the lower boom for pivotal movement on a turntable supported on the vehicle to turn about a generally vertical axis, said compensation system comprising:

an upper boom cylinder arranged between said upper and lower booms, said upper boom cylinder having an extend chamber for receiving fluid to extend the upper boom cylinder;

a lower boom cylinder connected between said lower boom and turntable, said lower boom cylinder having multiple fluid chambers for receiving fluid to extend and retract a single piston rod of the lower boom cylinder, at least two of said chambers being coupled to a common fluid supply source, said at least two chamber adapted to simultaneously receive fluid from said source;

means for applying fluid to at least a first one of said fluid chambers of the lower boom cylinder to effect extension of the lower boom cylinder; and means for connecting a second one of the fluid chambers of the lower boom cylinder with said extend chamber to transfer fluid from said second chamber to the extend chamber when fluid is applied to said first chamber.

6. A compensation system as set forth in claim 5, including means for applying fluid to said extend chamber of the upper boom cylinder independently of application of fluid to said first fluid chamber.

* * * * *